US007678952B2

(12) United States Patent
Dupain et al.

(10) Patent No.: US 7,678,952 B2
(45) Date of Patent: Mar. 16, 2010

(54) PROCESS TO PREPARE A GASOLINE

(75) Inventors: Xander Dupain, Delft (NL); Ralph Antoni Krul, Delft (NL); Michiel Makkee, Delft (NL); Jacob Adriaan Moulijn, Delft (NL)

(73) Assignee: Shell Oil Company, Houston, TX (US)

( * ) Notice: Subject to any disclaimer, the term of this patent is extended or adjusted under 35 U.S.C. 154(b) by 1149 days.

(21) Appl. No.: 10/558,054

(22) PCT Filed: May 26, 2004

(86) PCT No.: PCT/EP2004/050931

§ 371 (c)(1),
(2), (4) Date: Nov. 22, 2005

(87) PCT Pub. No.: WO2004/106462

PCT Pub. Date: Dec. 9, 2004

(65) Prior Publication Data

US 2006/0283778 A1 Dec. 21, 2006

(51) Int. Cl.
*C07C 4/00* (2006.01)

(52) U.S. Cl. ..... 585/330; 585/648; 585/469; 585/640; 208/134

(58) Field of Classification Search ..... None
See application file for complete search history.

(56) References Cited

U.S. PATENT DOCUMENTS

| | | | | |
|---|---|---|---|---|
| 4,125,566 | A | 11/1978 | Dinh et al. | 260/676 |
| 4,471,145 | A | 9/1984 | Chu et al. | 585/322 |
| 4,684,756 | A | 8/1987 | Derr, Jr. et al. | 585/330 |
| 5,278,114 | A | 1/1994 | Wielers et al. | 502/67 |
| 5,785,862 | A | 7/1998 | Graham et al. | 210/723 |
| 6,436,278 | B1 | 8/2002 | Benazzi et al. | 208/62 |
| 2002/0111521 | A1 | 8/2002 | O'Rear | 585/326 |

FOREIGN PATENT DOCUMENTS

| | | |
|---|---|---|
| AU | 698392 | 10/1989 |
| EP | 0454256 | 10/1991 |
| EP | 0512635 | 11/1992 |
| WO | 99/34917 | 7/1999 |

OTHER PUBLICATIONS

International Search Report dated Oct. 4, 2004.

*Primary Examiner*—Tam M Nguyen

(57) ABSTRACT

A process to prepare a gasoline fuel by contacting a Fischer-Tropsch product with a catalyst system of an acidic matrix and a large pore molecular sieve wherein the Fischer-Tropsch product has a weight ratio of compounds having at least 60 or more carbon atoms and compounds having at least 30 carbon atoms in the Fischer-Tropsch product of at least 0.2 and wherein at least 30 wt % of compounds in the Fischer-Tropsch product have at least 30 carbon atoms.

41 Claims, No Drawings

PROCESS TO PREPARE A GASOLINE

The present application claims priority on European Patent Application 03076643.0 filed 27 May 2003.

FIELD OF THE INVENTION

The invention relates to a process to prepare a gasoline from a Fischer-Tropsch product.

BACKGROUND OF THE INVENTION

Preparing a gasoline having an acceptable octane number from a Fischer-Tropsch product is not straightforward. This because the Fischer-Tropsch product, as such, consists for a large portion, of normal paraffins which have a low octane value or contribution. Various attempts have been made to provide a process which can prepare a gasoline from a Fischer-Tropsch product.

EP-A-512635 discloses a process wherein a gasoline having a motor octane number of 85 is obtained from a Fischer-Tropsch process by means of a hydroisomerization process. The process also involves separation of normal and iso-paraffins using a zeolite bed.

U.S. Pat. No. 6,436,278 discloses a similar process as EP-A-512635. The examples illustrate that the gasoline as directly obtained in a hydroisomerization step has an octane number of 43. After enrichment of the gasoline fraction in iso-paraffins the octane number of 68 was obtained.

US2002/0111521 discloses a process to a prepare gasoline by subjecting a Fischer-Tropsch wax to a so-called Paragon reactor to obtain lower olefins. These lower olefins are subsequently oligomerized to obtain a product boiling in the gasoline range.

EP-A-454256 discloses a process to prepare lower olefins from a Fischer-Tropsch product by contacting this product with a ZSM-5 containing catalyst at a temperature of between 580 and 700° C. in a moving bed reactor at a catalysts to oil ratio of between 65 and 86 kg/kg.

The disadvantage of the above-cited processes is that they involve hydroprocessing and/or multiple processing steps in order to obtain the desired gasoline fraction having the required motor octane number.

U.S. Pat. No 4,684,759 discloses a process to prepare a gasoline fraction by catalytic cracking of a Fischer-Tropsch wax as obtained in an iron catalysed Fischer-Tropsch process. The gasoline yield is 57.2 wt %.

A disadvantage of the process disclosed in U.S. Pat. No. 4,684,759 is that the yield to gasoline is relatively low.

It would be useful to provide a process which yields a gasoline fraction having an acceptable motor octane number from a Fischer-Tropsch product in a high yield.

The invention provides a process to prepare a gasoline fuel by contacting a Fischer-Tropsch product with a catalyst system comprising a catalyst, which catalyst comprises an acidic matrix and a large pore molecular sieve wherein the Fischer-Tropsch product has a weight ratio of compounds having at least 60 or more carbon atoms and compounds having at least 30 carbon atoms in the Fischer-Tropsch product is at least 0.2 and wherein at least 30 wt % of compounds in the Fischer-Tropsch product have at least 30 carbon atoms.

Applicants found that the combination of a relatively heavy Fischer-Tropsch product and the claimed catalyst can yield a gasoline product having a high content of iso-paraffins and olefins, compounds which greatly contribute to a high octane number. Another advantage is that a distillate fraction, which boils in the gas oil range, is obtained in a high yield and having excellent properties, for example Cetane Number, to be used as a diesel engine fuel or as a blending component for such a fuel. A further advantage is that no hydroprocessing is required. For example, the Fischer-Tropsch synthesis product can be directly used in the process according to the invention without having to hydrotreat the feed. Another advantage is that use can be made of well-known catalyst and reactors known for fluid catalytic cracking (FCC) processes.

The relatively heavy Fischer-Tropsch product used in step (a) has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}$+ fraction having an ASF-alpha value (Anderson-Schulz-Flory chain growth factor) of at least 0.925, preferably at least 0.935, more preferably at least 0.945, even more preferably at least 0.955.

The initial boiling point of the Fischer-Tropsch product may suitably range from below 200 up to 450° C. Preferably any compounds having 4 or less carbon atoms and any compounds having a boiling point in that range are separated from a Fischer-Tropsch synthesis product before the Fischer-Tropsch synthesis product is used in step (a). Applicants found that a high yield to gasoline can be achieved starting from such a Fischer-Tropsch product thus including the Fischer-Tropsch fractions boiling in the gasoline range. Thus a high gasoline yield relative to the Fischer-Tropsch product is achievable.

Preferably a gas oil fraction is separated from the Fischer-Tropsch product prior to using the product as feed. This fraction having a high cetane number may be advantageously blended with the gas oil fraction obtained in the process according to the present invention. With such a gas oil fraction is here meant the fraction which boils for more than 80 wt % between 215 and 370° C. This embodiment is advantageous because although the gasoline obtained by the present process has a good quality the gas oil has a lesser quality for use as diesel fuel blending component than if it would be obtained by a hydrocracking process as described in for example WO-A-02070628. To compensate for the loss of quality this straight run diesel as separated directly from the Fischer-Tropsch product, which has a very good Cetane number, is blended with the catalytically cracked gas oil fraction. The oxygenates present in the straight run gas oil fraction may be removed or retained prior to this blending.

Such a Fischer-Tropsch product may be obtained by any process which yields a relatively heavy Fischer-Tropsch product. Not all Fischer-Tropsch processes yield such a heavy product. Preferred processes are the cobalt catalyzed Fischer-Tropsch process. An example of a suitable Fischer-Tropsch process is described in WO-A-9934917 and in AU-A-698392. These processes may yield a Fischer-Tropsch product as described above.

A preferred catalyst to be used to obtain the relatively heavy Fischer-Tropsch product is suitably a cobalt-containing catalyst as obtainable by (aa) mixing (1) titania or a titania precursor, (2) a liquid, and (3) a cobalt compound, which is at least partially insoluble in the amount of liquid used, to form a mixture; (bb) shaping and drying of the mixture thus obtained; and (cc) calcination of the composition thus obtained.

Preferably at least 50 weight percent of the cobalt compound is insoluble in the amount of liquid used, more preferably at least 70 weight percent, and even more preferably at least 80 weight percent, and most preferably at least 90 weight percent. Preferably the cobalt compound is metallic cobalt powder, cobalt hydroxide or an cobalt oxide, more preferably $Co(OH)_2$ or $Co_3O_4$. Preferably the cobalt compound is used in an amount of up to 60 weight percent of the amount of refractory oxide, more preferably between 10 and 40 wt percent. Preferably the catalyst comprises at least one promoter metal, preferably manganese, vanadium, rhenium, ruthenium, zirconium, titanium or chromium, most preferably manganese. The promoter metal(s) is preferably used in such an amount that the atomic ratio of cobalt and promoter metal is at least 4, more preferably at least 5. Suitably at least one promoter metal compound is present in step (aa). Suitably the cobalt compound is obtained by precipitation, optionally followed by calcination. Preferably the cobalt compound and at least one of the compounds of promoter metal are obtained by co-precipitation, more preferably by co-precipitation at constant pH. Preferably the cobalt compound is precipitated in the presence of at least a part of the titania or the titania precursor, preferably in the presence of all titania or titania precursor. Preferably the mixing in step (aa) is performed by kneading or mulling. The thus obtained mixture is subsequently shaped by pelletising, extrusion, granulating or crushing, preferably by extrusion. Preferably the mixture obtained has a solids content in the range of from 30 to 90% by weight, preferably of from 50 to 80% by weight. Preferably the mixture formed in step (aa) is a slurry and the slurry thus-obtained is shaped and dried by spray-drying. Preferably the slurry obtained has a solids content in the range of from 1 to 30% by weight, more preferably of from 5 to 20% by weight. Preferably the calcination is carried out at a temperature between 400 and 750° C., more preferably between 500 and 650° C. Further details are described in WO-A-9934917.

The process is typically carried out at a temperature in the range from 125 to 350° C., preferably 175 to 275° C. The pressure is typically in the range from 5 to 150 bar abs., preferably from 5 to 80 bar abs., in particular from 5 to 70 bar abs. Synthesis gas, which is hydrogen and carbon monoxide, is typically fed to the process at a molar ratio in the range from 0.5 to 2.5. The gas hourly space velocity (GHSV) of the synthesis gas in the process of the present invention may vary within wide ranges and is typically in the range from 400 to 10000 Nl/l/h, for example from 400 to 4000 Nl/l/h. The term GHSV is well known in the art, and relates to the volume of synthesis gas in Nl, i.e. liters at STP conditions (0° C. and 1 bar abs), which is contacted in one hour with one liter of catalyst particles, i.e. excluding interparticular void spaces. In the case of a fixed catalyst bed, the GHSV may also be expressed as per liter of catalyst bed, i.e. including interparticular void space. The Fischer-Tropsch synthesis may be performed in a slurry reactor or preferably in a fixed bed. Further details are described in WO-A-9934917.

Synthesis gas may be obtained by well known processes like partial oxidation and steam reforming and combinations of these processes starting with a (hydro) carbon feedstock. Examples of possible feedstocks are natural gas, associated gas, refinery off-gas, residual fractions of crude oil, coal, pet coke and biomass, for example wood. Partial oxidation may be catalyzed or non-catalyzed. Steam reforming may be for example conventional steam reforming, autothermal (ATR) reforming and convective steam reforming.

The Fischer-Tropsch product will contain no or very little sulfur and nitrogen containing compounds. This is typical for a product derived from a Fischer-Tropsch reaction, which uses synthesis gas containing almost no impurities. Sulfur and nitrogen levels will generally be below the detection limits, which are currently 5 ppm for sulfur and 1 ppm for nitrogen.

The catalyst system used in the process according to the present invention will at least comprise a catalyst comprising a matrix and a large pore molecular sieve. Examples of suitable large pore molecular sieves are the faujasite (FAU) type as for example Zeolite Y, Ultra Stable Zeolite Y and Zeolite X. The matrix is preferably an acidic matrix. The acidic matrix will suitably comprise amorphous alumina and preferably more than 10 wt % of the catalyst is amorphous alumina. The matrix may further comprise, for example, aluminium phosphate, clay and silica and mixtures thereof. Amorphous alumina may also be used as a binder to provide the matrix with enough binding function to properly bind the molecular sieve. Examples of suitable catalysts are commercially available catalysts used in fluid catalytic cracking processes which catalysts comprise a Zeolite Y as the molecular sieve and at least alumina in the matrix.

The temperature at which feed and catalyst contact is preferably between 450 and 650° C. More preferably the temperature is above 475° C. and even more preferably above 500° C. Good gasoline yields are seen at temperatures above 600° C. However higher temperatures than 600° C. will give rise to thermal cracking reactions and the formation of non-desirable gaseous products like for example methane and ethane. For this reason the temperature is more preferably below 600° C. The process may be performed in various types of reactors. Because the coke make is relatively small as compared to a FCC process operating on a petroleum derived feed it is possible to conduct the process in a fixed bed reactor. In order to be able to regenerate the catalyst more simple preference is nevertheless given to either a fluidized bed reactor or a riser reactor. If the process is performed in a riser reactor the preferred contact time is between 1 and 10 seconds and more preferred between 2 and 7 seconds. The catalyst to oil ratio is preferably between 2 and 20 kg/kg. It has been found that good results may be obtained at low catalyst to oil ratios of below 15 and even below 10 kg/kg.

This is advantageous because this means a higher productivity per catalyst resulting in, for example, smaller equipment, less catalyst inventory, less energy requirement and/or higher productivity.

The catalyst system process may advantageously also comprise a medium pore size molecular sieve such to also obtain a high yield of propylene next to the gasoline fraction. Preferred medium pore size molecular sieves are zeolite beta, Erionite, Ferrierite, ZSM-5, ZSM-11, ZSM-12, ZSM-22, ZSM-23 or ZSM-57. The weight fraction of medium pore crystals on the total of molecular sieves present in this process is preferably between 2 and 20 wt %. The medium pore molecular sieve and the large pore molecular sieve may be combined in one catalyst particle or be present in different catalyst particles. Preferably the large and medium pore molecular sieve are present in different catalyst particles for practical reasons. For example the operator can thus add the two catalyst components of the catalyst system at different addition rates to the process. This could be required because of different deactivation rates of the two catalysts. The catalyst comprising the medium pore molecular sieve may also comprise of the above described matrix for the large pore molecular sieve catalyst particle. A suitable matrix is alumina. The molecular sieve may be dealuminated by, for example, steaming or other known techniques.

It has been found that the combination of the large pore molecular sieve, more preferably of the FAU type, in combination with the medium pore size molecular sieve, is important to achieve the high selectivities to the desired lower olefins, such as especially propylene and iso-butylene at the preferred catalyst to oil ratios as described above in a riser reactor. The invention is also directed to a process to prepare such lower olefins, such as propylene and/or iso-butylene. Iso-butylene and part or all of the propylene formed may advantageously be used to make high-octane compounds by well-known alkylation processes as will be described below in more detail.

Applicants have found that by performing the process according to the invention with a large pore molecular sieve, more preferably of the FAU type, in combination with the medium pore size molecular sieve as described above, not only lower olefin yield improves but the yield to iso-butane and iso-butylene also increases. Sometimes twice the amount of iso-butane is obtained when compared to a similar process performed in the absence of added medium pore size molecular sieve. Iso-butylene may be saturated to increase the amount of iso-butane as alkylation feedstock. The iso-$C_4$ fraction is ideally suited, in combination with part of the $C_3$—$C_8$ olefins produced in the above process, as feed to an alkylation process to make high octane blending product. This high octane blending product is preferably blended with the gasoline fraction as obtained in the main process. The optimal reactor conditions preferably include a catalyst contact temperature of above 500° C. and more preferably below 600° C. If the process is performed in a riser reactor the preferred contact time is between 1 and 10 seconds and more preferred between 2 and 7 seconds. The catalyst to oil ratio is preferably between 2 and 20 kg/kg. It has been found that good results may be obtained at low catalyst to oil ratios of below 15 and even below 10 kg/kg.

Possible alkylation processes are, for example, the Alky-Clean process as described in "The Process: A new solid acid catalyst gasoline alkylation technology," NPRA 2002 Annual Meeting, Mar. 17-19, 2002, the sulfuric acid alkylation process as for example described in Lerner, H., "Exxon sulfuric acid alkylation technology," Handbook of Petroleum Refining Processes, 2nd ed., R. A. Meyers, Ed., pp. 1.3-1.14., The TopsØe fixed-bed alkylation (FBA) technology and the The UOP Indirect Alkylation (InAlk) process. Other references to alkylation processes are found in U.S. Pat. No. 4,125,566.

The lower olefins as obtained by the above process may also be advantageously used to make $C_8$ alkenes, comprising 2,4,4-trimethylpentene, by oligomerization of n-butene and iso-butylene. An example of a possible process is described in for example U.S. Pat. Nos. 6,689,927, 4,197,185, 4,244,806 and 4,324,646. Also these $C_8$ alkenes are high octane blending components, which may be blended with the gasoline fraction as obtained in the main process. The $C_8$ alkenes may optionally be hydrogenated before being used as blending component.

The invention will be illustrated with the following non-limiting examples.

Comparative Experiment A-D

A Fischer-Tropsch product having the properties as listed in Table 1 was contacted with a hot regenerated catalyst at different temperatures and contact times at a catalyst to oil ratio of 4 kg/kg. The catalyst was a commercial FCC catalyst comprising an alumina matrix and Ultra Stable Zeolite Y, which had been obtained from a commercially operating FCC unit. The Zeolite Y content was 10 wt %. The operating conditions are presented in Table 3.

TABLE 1

| | |
|---|---|
| Initial boiling point | 100° C. |
| Fraction boiling between 25 and 215° C. (wt %) | 46.8 |
| Fraction boiling between 215 and 325° C. (wt %) | 42.2 |
| Fraction boiling above 325° C. (wt %) | 11.0 |

EXAMPLES 1-4

A Fischer-Tropsch product having the properties as listed in Table 2 was contacted with a hot regenerated catalyst at different temperatures and contact times as in Comparative Experiments A-D. The Fischer-Tropsch product was obtained according to Example VII using the catalyst of Example III of WO-A-9934917. The operating conditions are presented in Table 3.

TABLE 2

| | |
|---|---|
| Initial boiling point | 280° C. |
| Weight Fraction having 10 or less carbon atoms (%) | 0 |
| Weight Fraction having more than 30 carbon atoms (%) | 80 |
| Weight Fraction having more than 60 carbon atoms (%) | 50 |
| Ratio of $C_{60}+/C_{30}+$ | 0.63 |

TABLE 3

| Experiment | Example | Temperature (° C.) | Contact Time (seconds) |
|---|---|---|---|
| A | 1 | 500 | 4.06 |
| B | 2, 5 | 525 | 0.7 |
| C | 3, 6 | 525 | 4.06 |
| D | 4, 7 | 625 | 0.7 |

TABLE 4

| | Gasoline yield (wt %) (*) | Middle distillate yield (wt %) (**) | Gasoline iso-paraffins (wt % in gasoline fraction) | Gasoline iso-olefins (wt % in gasoline fraction) | Gasoline normal olefins (wt % in gasoline fraction) |
|---|---|---|---|---|---|
| A | — | — | — | — | — |
| 1 | 74.00 | 11.06 | 31.04 | 36.96 | 18.09 |
| B | 52.58 | 35.88 | 2.93 | 8.00 | 14.27 |
| 2 | 52.90 | 13.27 | 17.10 | 50.15 | 25.83 |
| C | 68.70 | 13.63 | 15.59 | 16.93 | 8.14 |
| 3 | 70.29 | 5.91 | 8.64 | 62.90 | 26.06 |
| D | 53.86 | 26.24 | 4.67 | 21.47 | 18.54 |
| 4 | 46.12 | 7.43 | 14.48 | 40.21 | 31.99 |

(*) Gasoline fraction defined as the distillation cut boiling between 25 and 215° C.
(**) Middle distillate defined as the distillation cut boiling between 215 and 325° C.

From Table 4 can be derived that the process according to the invention will provide a high yield to gasoline and/or a gasoline products. The gasoline fraction contains considerably more compounds, which contribute to a high octane number. The prior art method yields a predominantly normal paraffin product, which will have a considerably lower octane number.

Table 4. also shows that a high gasoline yield is obtained at high contact times and relatively mild temperatures (Examples 1 and 3).

EXAMPLES 5-7

Examples 2-4 was repeated with the Fischer-Tropsch product having the properties as listed in Table 5 and the conditions of Table 3. The results are presented in Table 6.

TABLE 5

| | |
|---|---|
| Initial boiling point | 100° C. |
| Weight Fraction having 10 or less carbon atoms (%) | 14 |
| Weight Fraction having more than 30 carbon atoms (%) | 62 |
| Weight Fraction having more than 60 carbon atoms (%) | 39 |
| Ratio of $C_{60}$+/$C_{30}$+ | 0.63 |

TABLE 6

| Example | Gasoline yield (wt %) on total product | Gasoline iso-paraffins (wt % in gasoline fraction) | Gasoline iso-olefins (wt % in gasoline fractions) | Gasoline normal olefins (wt % in gasoline fractions) |
|---|---|---|---|---|
| 5 | 75.3 | 14.91 | 43.64 | 24.04 |
| 6 | 86.0 | 9.71 | 55.84 | 23.30 |
| 7 | 56.8 | 12.94 | 37.25 | 29.87 |

EXAMPLE 8

Example 6 was repeated except that part of the catalyst was exchanged for a 25 wt % ZSM-5 containing catalyst. The content of ZSM-5 based catalyst on the whole catalyst charge was 20 wt % (as calculated on the total catalyst weight). The gasoline yield was 51.7 wt %. The content of iso-paraffins was 4.20 wt %, iso-olefins was 53.53 wt % and normal olefins was 22.72 wt % in the gasoline fraction. The propylene yield was 15 wt % as compared to a propylene yield in Example 6 of 4.85 wt % (calculated on total product).

EXAMPLE 9

Examples 5 was repeated except that part of the catalyst was exchanged for a 25 wt % ZSM-5 containing catalyst. The content of ZSM-5 based catalyst on the whole catalyst charge was 20 wt % (as calculated on the total catalyst weight). The results are presented in Table 7.

EXAMPLE 10

Example 6 was repeated except that part of the catalyst was exchanged for a 25 wt % ZSM-5 containing catalyst. The content of ZSM-5 based catalyst on the whole catalyst charge was 20 wt % (as calculated on the total catalyst weight). The results are presented in Table 7.

TABLE 7

| Example | Gasoline yield on product (wt %) (*) | Gasoline iso-paraffins (wt %) | Gasoline iso-olefins (wt %) | Gasoline normal olefins (wt %) |
|---|---|---|---|---|
| 5 | 52.90 | 7.31 | 21.44 | 11.04 |
| 6 | 70.29 | 4.38 | 31.91 | 13.22 |
| 9 | 55.88 | 20.27 | 11.70 | 10.40 |
| 10 | 45.76 | 0.25 | 19.83 | 8.32 |
| | Iso-butylene yield (wt %) | Iso-butane yield (wt %) | n-butene (wt %) | Propylene yield (wt %) |

TABLE 7-continued

| | | | | |
|---|---|---|---|---|
| 5 | 0.8 | 1.5 | 5 | 2.77 |
| 6 | 2.5 | 1.0 | 3 | 4.73 |
| 9 | 4.9 | 2.5 | 6 | 13.89 |
| 10 | 7.9 | 3.5 | 10 | 16.45 |

(*) all yields in Table 7 on total product

We claim:

1. A process to prepare a gasoline fuel comprising: contacting a Fischer-Tropsch product with a catalyst system comprising a catalyst, which catalyst comprises an acidic matrix and a large pore molecular sieve, wherein the Fischer-Tropsch product is a product obtained by a Fischer-Tropsch process catalyzed by a cobalt catalyst, the Fisher-Tropsch product comprises a C20+ fraction having an ASF-alpha value of at least 0,925, the Fischer-Tropsch product has a weight ratio of compounds having at least 60 carbon atoms to compounds having at least 30 carbon atoms of at least 0.2, and at least 30 wt % of compounds in the Fischer-Tropsch product have at least 30 carbon atoms.

2. The process of claim 1, wherein at least 50 wt % of compounds in the Fischer-Tropsch product have at least 30 carbon atoms.

3. The process of claim 1, wherein the Fischer-Tropsch product has a weight ratio of compounds having at least 60 carbon atoms to compounds having at least 30 carbon atoms of at least 0.4.

4. The process of claim 1, wherein contacting occurs at a temperature between 450° C. and 650° C.

5. The process of claim 1, wherein the acidic matrix is alumina.

6. The process of claim 1, wherein the large pore molecular sieve is of the Faujasite type.

7. The process of claim 1, wherein the catalyst also comprises a medium pore size molecular sieve selected from the group consisting of zeolite beta, Erionite, Ferrierite, ZSM-5, ZSM-11, ZSM-12, ZSM-22, ZSM-23 and ZSM-57.

8. The process of claim 1, wherein contacting is performed in a reactor selected from the group consisting of a fixed bed reactor, a fluidized bed reactor and a riser reactor.

9. The process of claim 8, wherein contacting is performed in a riser reactor at a contact time of between 2 seconds and 10 seconds, a temperature of between 500° C. and 600° C. and a catalyst to oil ratio of between 2 kg/kg and 20 kg/kg.

10. A process to prepare gasoline comprising:

performing a Fischer-Tropsch reaction using a cobalt catalyst thereby obtaining a Fischer-Tropsch product having a weight ratio of compounds having at least 60 carbon atoms to compounds having at least 30 carbon atoms of at least 0.2 and having at least 30 wt % of compounds in the Fischer-Tropsch product having at least 30 carbon atoms and having the Fisher-Tropsch product comprised of a C20+ fraction having an ASF-alpha value of at least 0.925, contacting the Fischer-Tropsch product with a catalyst comprising an acidic matrix and a large pore molecular sieve, and isolating a gasoline fraction.

11. The process of claim 10, wherein the contacting of the Fischer-Tropsch product and the catalyst is performed in a riser reactor at a temperature of between 500° C. and 600° C. and a contact time of between 2 and 10 seconds.

12. The process of claim 10, wherein the cobalt catalyst is prepared by a process comprising: (aa) mixing (1) titania or a titania precursor, (2) a liquid, and (3) a cobalt compound, which is at least partially insoluble in the amount of liquid used, to form a mixture;

(bb) shaping and drying of the mixture thus obtained to obtain a composition; and (cc) calcining the composition thus prepared.

13. The process of claim 2, wherein the Fischer-Tropsch product has a weight ratio of compounds having at least 60 carbon atoms to compounds having at least 30 carbon atoms of at least 0.4.

14. The process of claim 2, wherein contacting occurs at a temperature between 450° C. and 650° C.

15. The process of claim 2, wherein the acidic matrix is alumina.

16. The process of claim 2, wherein the large pore molecular sieve is of the Faujasite type.

17. The process of claim 2, wherein the catalyst also comprises a medium pore size molecular sieve selected from the group consisting of zeolite beta, Erionite, Ferrierite, ZSM-5, ZSM-11, ZSM-12, ZSM-22, ZSM-23 and ZSM-57.

18. The process of claim 2, wherein contacting is performed in a reactor selected from the group consisting of a fixed bed reactor, a fluidized bed reactor and a riser reactor.

19. The process of claim 18, wherein contacting is performed in a riser reactor at a contact time of between 2 seconds and 10 seconds, a temperature of between 500° C. and 600° C. and a catalyst to oil ratio of between 2 kg/kg and 20 kg/kg.

20. The process of claim 3, wherein contacting occurs at a temperature between 450° C. and 650° C.

21. The process of claim 3, wherein the acidic matrix is alumina.

22. The process of claim 3, wherein the large pore molecular sieve is of the Faujasite type.

23. The process of claim 3, wherein the catalyst also comprises a medium pore size molecular sieve selected from the group consisting of zeolite beta, Erionite, Ferrierite, ZSM-5, ZSM-11, ZSM-12, ZSM-22, ZSM-23 and ZSM-57.

24. The process of claim 3, wherein contacting is performed in a reactor selected from the group consisting of a fixed bed reactor, a fluidized bed reactor and a riser reactor.

25. The process of claim 24, wherein contacting is performed in a riser reactor at a contact time of between 2 seconds and 10 seconds, a temperature of between 500° C. and 600° C. and a catalyst to oil ratio of between 2 kg/kg and 20 kg/kg.

26. The process of claim 4, wherein the acidic matrix is alumina.

27. The process of claim 4, wherein the large pore molecular sieve is of the Faujasite type.

28. The process of claim 4, wherein the catalyst also comprises a medium pore size molecular sieve selected from the group consisting of zeolite beta, Erionite, Ferrierite, ZSM-5, ZSM-11, ZSM-12, ZSM-22, ZSM-23 and ZSM-57.

29. The process of claim 4, wherein contacting is performed in a reactor selected from the group consisting of a fixed bed reactor, a fluidized bed reactor and a riser reactor.

30. The process of claim 29, wherein contacting is performed in a riser reactor at a contact time of between 2 seconds and 10 seconds, a temperature of between 500° C. and 600° C. and a catalyst to oil ratio of between 2 kg/kg and 20 kg/kg.

31. The process of claim 5, wherein the large pore molecular sieve is of the Faujasite type.

32. The process of claim 5, wherein the catalyst also comprises a medium pore size molecular sieve selected from the group consisting of zeolite beta, Erionite, Ferrierite, ZSM-5, ZSM-11, ZSM-12, ZSM-22, ZSM-23 and ZSM-57.

33. The process of claim 5, wherein contacting is performed in a reactor selected from the group consisting of a fixed bed reactor, a fluidized bed reactor and a riser reactor.

34. The process of claim 33, wherein contacting is performed in a riser reactor at a contact time of between 2 seconds and 10 seconds, a temperature of between 500° C. and 600° C. and a catalyst to oil ratio of between 2 kg/kg and 20 kg/kg.

35. The process of claim 6, wherein the catalyst also comprises a medium pore size molecular sieve selected from the group consisting of zeolite beta, Erionite, Ferrierite, ZSM-5, ZSM-11, ZSM-12, ZSM-22, ZSM-23 and ZSM-57.

36. The process of claim 6, wherein contacting is performed in a reactor selected from the group consisting of a fixed bed reactor, a fluidized bed reactor and a riser reactor.

37. The process of claim 36, wherein contacting is performed in a riser reactor at a contact time of between 2 seconds and 10 seconds, a temperature of between 500° C. and 600° C. and a catalyst to oil ratio of between 2 kg/kg and 20 kg/kg.

38. The process of claim 7, wherein contacting is performed in a reactor selected from the group consisting of a fixed bed reactor, a fluidized bed reactor and a riser reactor.

39. The process of claim 38, wherein contacting is performed in a riser reactor at a contact time of between 2 seconds and 10 seconds, a temperature of between 500° C. and 600° C. and a catalyst to oil ratio of between 2 kg/kg and 20 kg/kg.

40. The process of claim 11, wherein the cobalt catalyst is obtained by a process comprising: (aa) mixing (1) titania or a titania precursor, (2) a liquid, and (3) a cobalt compound, which is at least partially insoluble in the amount of liquid used, to form a mixture;

(bb) shaping and drying of the mixture thus obtained to obtain a composition; and (cc) calcining the composition thus obtained.

41. The process of claim 10, wherein the Fischer-Tropsch reaction is performed in a tubular reactor.

* * * * *